United States Patent [19]

Stevens

[11] 4,338,976

[45] Jul. 13, 1982

[54] TOOL FOR ATTACHING A DROPPER TO A FENCE WIRE

[76] Inventor: Neill F. Stevens, 47a Wellesley Rd., Napier, New Zealand

[21] Appl. No.: 142,574

[22] Filed: Apr. 18, 1980

[30] Foreign Application Priority Data

Apr. 19, 1979 [NZ] New Zealand ..... 190227

[51] Int. Cl.[3] ..... B21F 27/08

[52] U.S. Cl. ..... 140/12; 140/21; 140/124

[58] Field of Search ..... 140/10, 11, 12, 13, 140/14, 18, 19, 21, 22, 23, 123, 124

[56] References Cited

U.S. PATENT DOCUMENTS 544,740 8/1895 Munger ..... 140/21

585,345 6/1897 Sheek ..... 140/19

609,535 8/1898 Davis ..... 140/21

*Primary Examiner*—Howard N. Goldberg

*Assistant Examiner*—Fred A. Silverberg

*Attorney, Agent, or Firm*—Cushman, Darby & Cushman

[57] ABSTRACT

A tool for attaching a wire dropper or batten to the wires of a fence line comprises a body having first and second wire engagement devices which are located at substantially right angles to one another. The body includes a lever mounting device which can receive a lever for operating the tool. The tool is used by engaging a fence wire in the first wire engagement device and the wire dropper or batten in the second wire engagement device. The body is then rotated about an axis which is coaxial or parallel with the longitudinal axis of the fence wire so as to wind the wire dropper or batten onto the fence wire.

10 Claims, 5 Drawing Figures

TOOL FOR ATTACHING A DROPPER TO A FENCE WIRE

This invention relates to a fencing tool and more particularly to a tool by which a dropper or batten can be attached into a wire fence line.

BACKGROUND AND SUMMARY OF THE INVENTION

Many forms of fencing droppers or battens for wire fence lines are known. Among these known droppers or battens are wooden members one piece or sectional sheet metal members or simply a length of fencing wire tied or otherwise clamped onto the wires of the fence line. The tool of the present invention is designed to provide an economical but effective and quick method of attaching a wire dropper or batten to the wires of a fence line.

Broadly the invention provides a tool for attaching a wire dropper to a wire of a fence line comprising a body with a first wire engagement means for reception of a fence wire, lever mounting means for the reception of a lever whereby said body can be rotated by said lever about an axis which is parallel with the longitudinal axis of said fence wire, when the fence wire is engaged in said first wire engagement means, second wire engagement means for the reception of a wire dropper, said second wire engagement means located substantially at right angles to said first wire engagement means so that a dropper engaged in said second engagement means lies at right angles to said fence wire, said second wire engagement means comprising a support recess which is located on said body in a position which is to one side of the rotational axis of said body, the support recess terminating at a distance from said rotational axis which is at least equal to the sum of the radii of said fence wire and said dropper, the body further including ramp means located adjacent said support recess whereby with a fence wire and a dropper wire received in the respective first and second wire engagement means and the body rotated about said rotational axis the dropper wire is wound around said fence wire and said ramp means engages with said dropper wire to cause deflection thereof such that said dropper wire is coiled about said fence wire.

BRIEF DESCRIPTION OF THE DRAWINGS

In more fully describing the invention reference will be made to the accompanying drawings in which.

Figure 1:
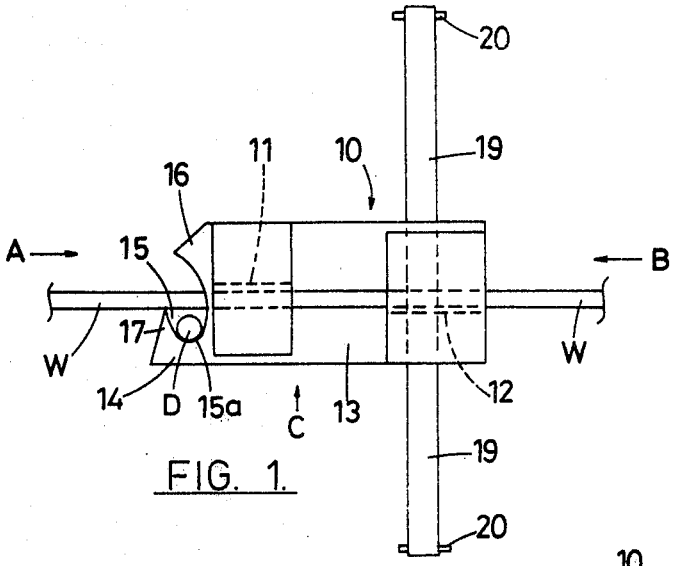
FIG. 1 is an elevation view of the tool according to the invention.

The body 10 can be of any convenient shape and construction. In the drawings body 10 is of generally rectangular cross-section. The material from which the body is constructed can be a suitable metal or plastics material which is for example cast or fabricated into the required configuration.

The first wire engagement means consists of a pair of receiving grooves 11 and 12 which are aligned but located apart so that there is wire receiving space 13 between them. When viewing the body 10 in the manner as illustrated in the drawings the forward groove 11 is inverted. The cross-sectional dimensions of grooves 11 and 12 are such as to accommodate the diameter of a fence wire.

Figure 2:
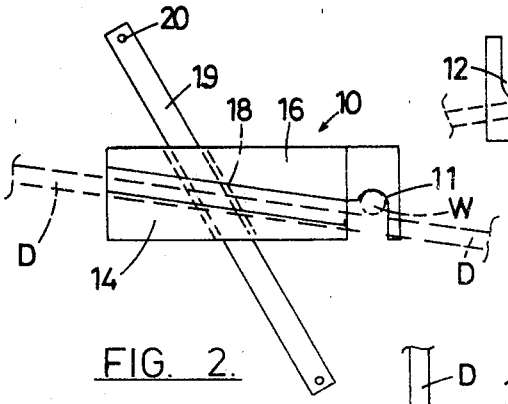
FIG. 2 is an elevational view taken in the direction of arrow A.

Situated at right angles to the first wire engagement means is the second wire engagement means which is a lipped projection 14 extending from body 10 which defines an elongate recess 15. The floor 15*a* of recess 15 at the corner of body 10 adjacent groove 11 is at a lower level than groove 11 with the distance below groove 12 being substantially equal to the combined radii of the fence wire and the wire which forms the dropper or batten. Referring to FIG. 2 it will be seen that the recess 15 slopes upwardly away from the corner of body 10 adjacent groove 11.

A ramp 16 is located above the lip 17 of projection 14 and has a height which is approximately the same as the outer face of lip 17 from the face of the body 10. Ramp 16 slopes toward lip 17 in the manner illustrated in FIGS. 1 and 2. As can be seen ramp 16 is of increasing width toward the aforesaid corner of the body.

Figure 3:
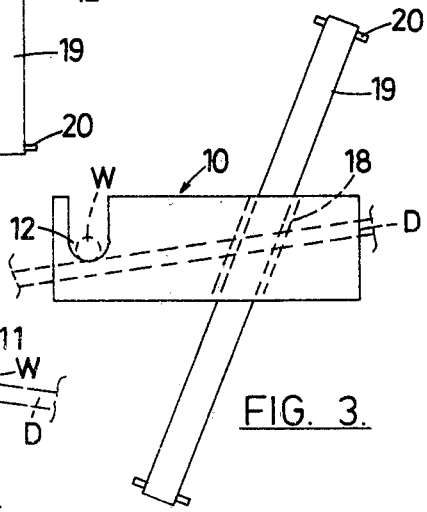
FIG. 3 is an elevational view taken in the direction of arrow B.
Figure 4:
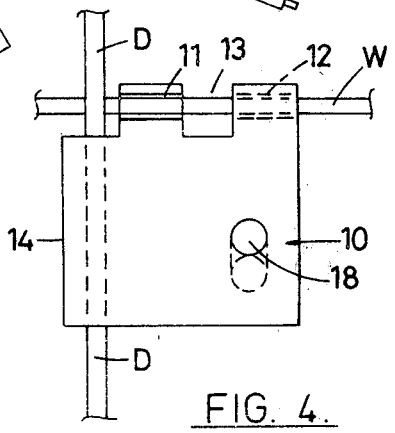
FIG. 4 is a bottom plan view taken in the direction of arrow C.

The lever mounting means is formed by an inclined bore 18 in body 10 said bore 18 having its longitudinal axis set at an angle to grooves 11 and 12 as can be seen in FIGS. 2 and 3. A lever 19 in the form of a short length of metal can be located in bore 18 to be slidable therein. Stops 20 can be provided at each end of lever 19 to prevent it from sliding from bore 18.

In use the wire dropper or batten is tied onto the top or bottom wire of the fence line. To maintain the wires of the fence in their correct spacial disposition a spacer tool is used. In its simplest form the tool is a tubular member provided with cut outs along its length. These cut outs are positioned in the same spacial disposition as the fence wires. The fence wires are slid into the respective cut outs and a length of wire is then slid down the interior of the tubular member to be located between the fence wires and the wall portion of the tubular member having the cut outs. In this way the fence wires are captured within the spacer tool.

Figure 5:
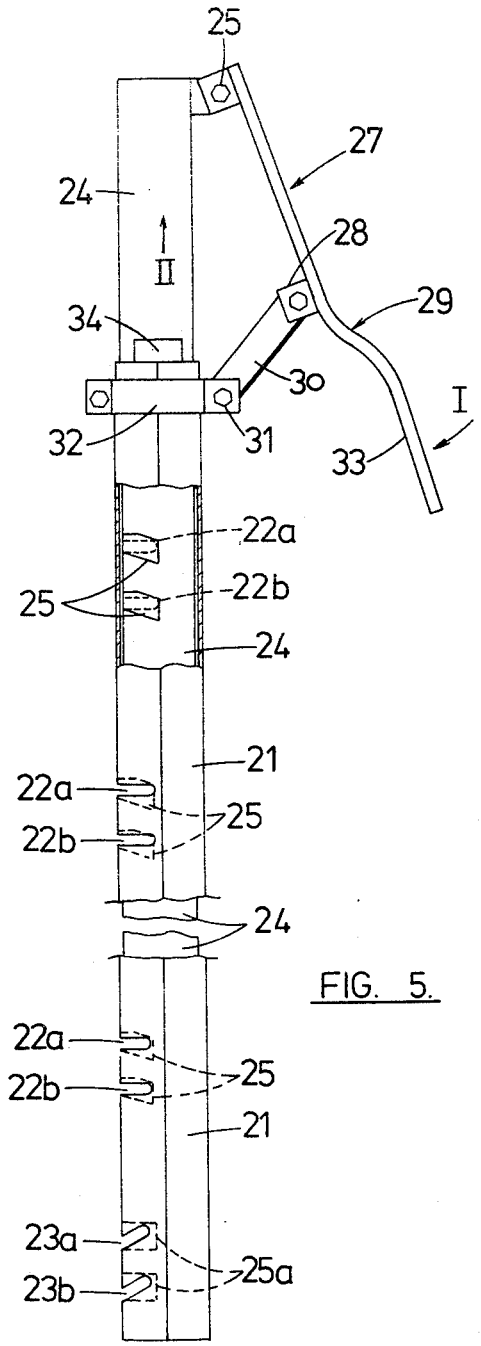
FIG. 5 is a partially sectioned elevational view of a spacer tool for use with the tool of the present invention.

Referring to FIG. 5 of the drawings there is shown an example of the spacer tool which is used in conjunction with the tool of the present invention. In this form the spacer tool is made from a length of square tube 21 in which slots 22 have been cut at right angles across the diagonal of the tube 21. The disposition of slots 22 match the spacing of the fence wires. The lower slots 23 (which are for the bottom wire or wires) are at an angle, in this case approximately 45°, to slots 22. The distance between the upper angled slot 23 and the adjacent slot 22 is preferably 0.5 inch greater than the required spacing to allow for the drag of the batten wire on the bottom fence wires.

The locking mechanism is a bar 24 which fits diagonally in tube 21 to slide therein. Bar 24 has a series of angled slots 25 cut therein which are wider than slots 22 and 23 but are in a spacial array substantially the same as slots 22 and 23. Bar 24 projects from the upper end of tube 21 and is pivotally coupled at 25 to the end of a cranked handle 27. This handle 27 has a projection 28 extending from bar 24 in the vicinity of cranked portion 29. A short arm 30 pivotally coupled to handle 27 at projection 28 is further pivotted at 31 to a clamp 32 which is clamped to the upper end of tube 21. As handle end 33 is moved in the direction of arrow I bar 24 moves up tube 24 in the direction of arrow II so that lower edges of slots 25 move over and thus close the open ends of slots 22 and 23. The handle 27 by virtue of its mounting works on an overcentre operation. A stop 34 is provided on bar 24 to come in contact with the top of tube 21 to limit the movement of bar 24 down the tube 21 when slots 22 and 23 are opened. The extent of movement can be adjusted by the position of clamp 32 on tube 21.

As with the previously described arrangement the fence wires are positioned in slots 22 and 23 whereupon handle 27 is operated to push bar 24 down tube 21 in direction II. This movement closes the ends of slots 22 and 23 because of the relative angle of slots 22 and 23 with respect to slots 25. The wires are thus captured in slots 22 and 23 until the bar 24 is lifted.

With the spacer tool in position and the dropper wire tied to the top or bottom fence wire the tool of the invention is positioned on the next fence wire. This is achieved by the fence wire W being positioned in space 13 and the body 10 rotated by 90° so that wire W resides in grooves 11 and 12 in the manner shown in FIG. 1. The dropper wire D is then located in the recess 15 provided by lipped projection 14 and due to the difference in levels wire D is situated below wire W. Using lever 19 body 10 is rotated about an axis which is substantially axial with wire W. This rotational movement loops dropper wire D tightly around wire W. As wire D comes to complete a full turn it engages with ramp 16 so that it is moved outwardly to lie alongside the portion of its length already in position on wire W. The spacer tool maintains the fence wires W evenly spaced and also allows the batten wire D to be tightly wound around wire W.

When a full turn is completed the tool is removed and then positioned on the next fence wire preparatory to dropper wire D being coupled therewith. This process is continued until the dropper wire is coupled with all the fence wires whereupon the spacer tool maintaining the fence wires in their correct disposition is removed.

I claim:

1. A tool for attaching a wire dropper to a wire of a fence line comprising a body with a first wire engagement means for reception of a fence wire, lever mounting means for the reception of a lever whereby said body is rotated by said lever about a rotational axis of said body which is parallel with the longitudinal axis of said fence wire, when the fence wire is engaged in said first wire engagement means, second wire engagement means for the reception of a wire dropper, said second wire engagement means located substantially at right angles to said first wire engagement means so that a dropper engaged in said second engagement means lies at right angles to said fence wire, said second wire engagement means comprising a support recess which is located in said body in a position which is to one side of the rotational axis of said body, the support recess terminating at a distance from said rotational axis which is at least equal to the sum of the radii of said fence wire and said dropper, the body further including ramp means located adjacent said support recess whereby with a fence wire and a dropper wire received in the respective first and second wire engagement means and the body rotated about said rotational axis the dropper wire is wound around said fence wire and said ramp means engages with said dropper wire to cause deflection thereof such that said dropper wire is coiled about said fence wire.

2. A tool as claimed in claim 1 wherein said first wire engagement means is formed by a pair of aligned but oppositely directed grooves.

3. A tool as claimed in claim 2 wherein each groove of the said pair of grooves is formed as part of a projection from said body, said projections being located in a spaced apart array.

4. A tool as claimed in claim 3 wherein, said pair of grooves and said ramp means are formed integrally with said body.

5. A tool as claimed in claim 2 or 3 wherein said support recess and said pair of grooves are located on sides of said body which are at right angles to one another.

6. A tool as claimed in claim 5 wherein the support recess slopes upwardly away from said intersection of the sides, said ramp means extending for the length of said recess and being of progressively increasing width toward said intersection.

7. A tool as claimed in claim 6 wherein the lever mounting means is a bore through said body and in which the lever is slidingly located, said lever being an elongate lever and being in a plane which is at right angles to the plane of the side of the body having said pair of grooves.

8. A tool as claimed in claim 1 or 2 in combination with a spacer tool for maintaining the fence wires of a fence line in the required spacial disposition when said dropper is being fixed thereon said spacer tool comprising a hollow elongate body with a series of open ended slots cut therein, the slots being spaced apart in conformity with the required spacial disposition of said fence wires, a moveable element adapted to locate within said hollow body to restrict the open ends of said slots when said fence wires are disposed within said slots.

9. A tool combination as claimed in claim 8 wherein the moveable element is slidingly retained in said hollow body, said moveable element having a series of spaced apart open ended slots which conform in their spacial array with the hollow body.

10. A tool combination as claimed in claim 9 wherein said spacer tool includes operating means which in use moves said movable element between a first position where the open ended slots of said element and said hollow body are in register and to a second locked position where a portion of one edge of each of the slots of said moveable element restricts the open end of the slots of said hollow body.

* * * * *